US005961116A

United States Patent [19]

Beyer

[11] Patent Number: 5,961,116

[45] Date of Patent: Oct. 5, 1999

[54] SLAP BALL TABLE GAME APPARATUS

[76] Inventor: Kenneth J. Beyer, 1103 Murphy, Joplin, Mo. 64801

[21] Appl. No.: 09/098,575

[22] Filed: Jun. 17, 1998

Related U.S. Application Data

[60] Provisional application No. 60/051,417, Jul. 1, 1997.

[51] Int. Cl.[6] ..... A63F 7/00

[52] U.S. Cl. ..... 273/119 R; 273/108.1; 273/129 R

[58] Field of Search ..... 273/108.1, 126 R, 273/126 A, 118 R, 118 A, 119 R, 119 A, 121 R, 121 A, 129 R, 129 V

[56] References Cited

U.S. PATENT DOCUMENTS

| | | | |
|---|---|---|---|
| D. 264,855 | 6/1982 | Ohkado . | |
| D. 337,790 | 7/1993 | Gottlieb et al. . | |
| 3,452,987 | 7/1969 | Di Motta | 273/121 A |
| 3,582,074 | 6/1971 | Menotti | 273/121 A |
| 3,913,918 | 10/1975 | Trachtman | 273/126 A |
| 3,975,019 | 8/1976 | Barlow . | |
| 4,046,380 | 9/1977 | Goldfarb et al. | 273/119 R |
| 4,105,207 | 8/1978 | Cooper et al. . | |
| 4,244,575 | 1/1981 | Hori . | |
| 4,269,413 | 5/1981 | Langieri . | |
| 4,291,879 | 9/1981 | Nagato | 273/119 R |
| 4,986,543 | 1/1991 | Heller | 273/121 A |
| 5,064,196 | 11/1991 | Gottlieb | 273/121 A |
| 5,088,736 | 2/1992 | Chuang | 273/121 R |
| 5,131,654 | 7/1992 | Gottlieb et al. | 273/129 V X |
| 5,238,248 | 8/1993 | Gottlieb | 273/121 A |
| 5,788,231 | 8/1998 | To | 273/126 R |

*Primary Examiner*—Raleigh Chiu

[57] ABSTRACT

A table game apparatus includes a playing field assembly which includes a ground portion and walls which project upward from edges of the ground portion. Width-extending walls and length-extending walls are arranged on the top side of the ground portion in a four-cornered rectangular array. A first ball launching assembly is located at a first corner of the four-cornered rectangular array. A second ball launching assembly located at a second corner of the four-cornered rectangular array. First and second pairs of flippers are located on the ground portion. First and second pairs of flipper control assemblies are provided for controlling the first and second pairs of flippers. The first and second pairs of flipper control assemblies are supported by the ground portion. A first goal area is located on the ground portion behind and between the first pair of flippers. A first ball retention region is located behind the first goal area. A second goal area is located on the ground portion behind and between the second pair of flippers. A second ball retention region is located behind the second goal area An array of bumpers are located on the ground portion, and a plurality of balls are launched by the first ball launching assembly and the second ball launching assembly. The object of the game is for one player to be the first to get a predetermined number of balls through the opposing player's goal area.

17 Claims, 3 Drawing Sheets

FIG 3
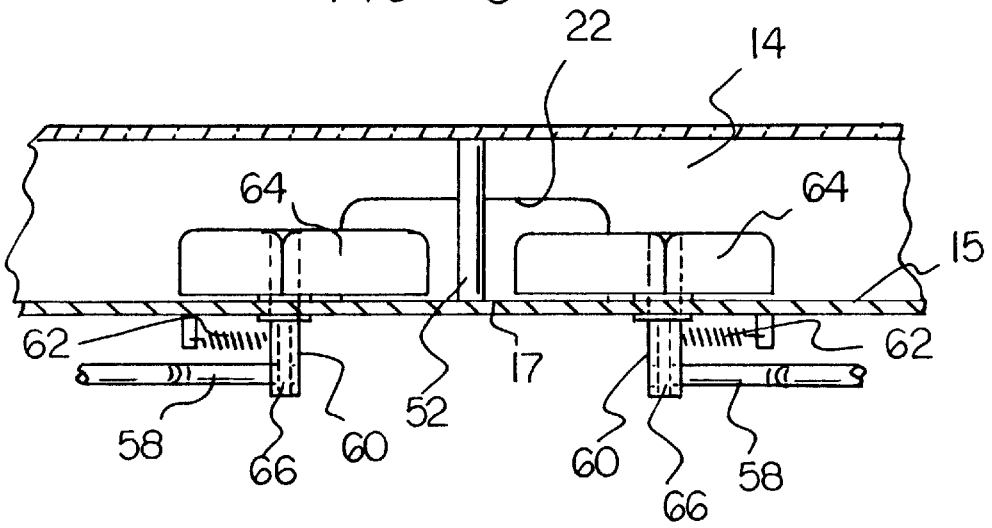
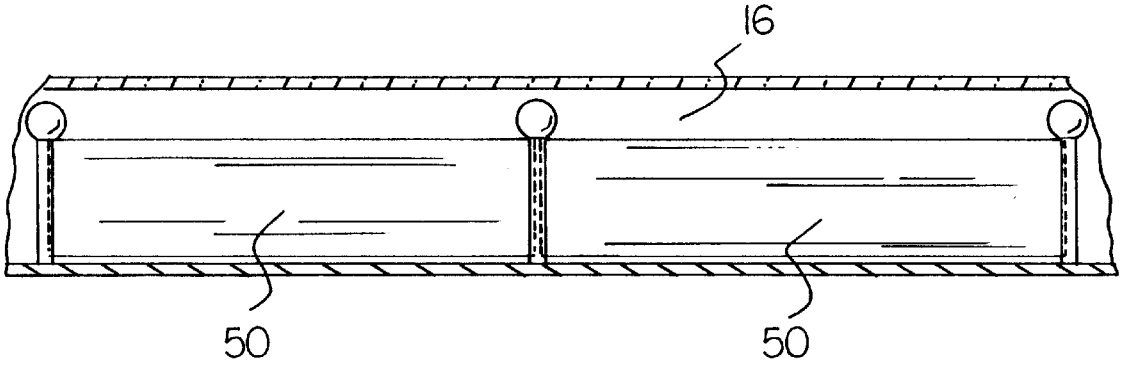
FIG 4

SLAP BALL TABLE GAME APPARATUS

CROSS-REFERENCE TO RELATED APPLICATION

This application claims priority based upon my prior copending Provisional Application Ser. No. 60/051,417, filed Jul. 1, 1997.

BACKGROUND OF THE INVENTION

1. Field of the Invention

The present invention relates generally to amusement devices and, more particularly, to amusement devices which employ a small ball or puck which is propelled along a small horizontal surface, such as a table-like surface.

2. Description of the Prior Art

Among known amusement devices that employ a small ball that is propelled along a small horizontal surface, a well known class of such devices are pinball machines. Throughout the years, a number of innovations have been developed relating to pinball machines, and the following U.S. patents are representative of some of those innovations: Des. 264, 855, Des. 337,790, 3,975,019, 4,105,207, 4,224,575, and 4,269,413. Each of the devices in each of the respective patents share a common characteristic, Operation of the machine involves a single player operating the machine. With this class of machines, a player competes against one's self by trying to earn higher scores in successive games.

Alternatively, a player can compete against other players by comparing one's score to the scores of other players who have also played on the machine. With such machines, competition with other players is carried out by individual players playing in succession. To add greater excitement to competition between players, it would be desirable if a pinball-machine-like device could be provided that permits two players to play simultaneously.

In games such as tennis, football, basketball, hockey, and soccer, among others, during a game, a player on one team needs to quickly alternate from offensive to defensive play. Such quick alternation from offense to defense to offense, and so on, adds excitement and interest to the game. In this respect, it would be desirable if a pinball-machine-like device could be provided that permits rapid alternation from offensive to defensive to offensive, and so on, play between two players playing simultaneously.

Among the pinball machines cited above, some are complex electronic devices. For purposes of simplicity and to be able to play a pinball-machine-like device without the need to be near a source of electric power, it would be desirable if a pinball-machine-like device could be provided that does not employ electric power.

In addition, for convenience, it would be desirable if a pinball-machine-like device could be provided that is lightweight and portable and that can easily be placed on a horizontal table to use the machine.

Thus, while the foregoing body of prior art indicates it to be well known to use pinball machines, the prior art described above does not teach or suggest a slap ball table game apparatus which has the following combination of desirable features: (1) permits two players to play simultaneously, (2) permits rapid alternation from offensive to defensive to offensive, and so on, play between two players playing simultaneously; (3) does not employ electric power; and (4) is lightweight and portable and can easily be placed on a horizontal table to use the device. The foregoing desired characteristics are provided by the unique slap ball table game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a table game apparatus which includes a playing field assembly which includes a ground portion and walls which project upward from edges of the ground portion. The ground portion includes a top side and a bottom side. The walls include width-extending walls and length-extending walls. The width-extending walls and the length-extending walls are arranged on the top side of the ground portion in a four-cornered rectangular array. A first ball launching assembly is located at a first corner of the four-cornered rectangular array. A second ball launching assembly located at a second corner of the four-cornered rectangular array. A first pair of flippers are located on the ground portion. A first pair of flipper control assemblies are provided for controlling the first pair of flippers. The first pair of flipper control assemblies are supported by the ground portion. A first goal area is located on the ground portion behind and between the first pair of flippers. A first ball retention region is located behind the first goal area.

A second pair of flippers are located on the ground portion. A second pair of flipper control assemblies are provided for controlling the second pair of flippers. The second pair of flipper control assemblies are supported by the ground portion. A second goal area is located on the ground portion behind and between the second pair of flippers. A second ball retention region is located behind the second goal area. The object of the game is for one player to be the first to get a predetermined number of balls through the opposing player's goal area.

An array of bumpers are located on the ground portion, and a plurality of balls are launched by the first ball launching assembly and the second ball launching assembly. Each of the first ball launching assembly and the second ball launching assembly is located at a respective corner in the four-cornered rectangular array and includes a launch rod supported by a width-extending wall. The launch rod has a handle portion and a ball driver portion. A drive spring is located between the ball driver portion and the width-extending wall. A guide wall is supported by the ground portion. The guide wall is parallel to the length-extending walls. The combination of one of the length-extending walls, the guide wall, and the ground portion define a ball-launching runway.

The ground portion can include a first downwardly sloping portion and a second downwardly sloping portion. The first downwardly sloping portion and the second downwardly sloping portion slope downward from a center portion of the ground portion to peripheral portions of the ground portion. Each of the first goal area and the second goal area is located medially along a respective width-extending wall. Each of the first goal area and the second goal area is an aperture in a respective width-extending wall.

Each of the first pair of flipper control assemblies and the second pair of flipper control assemblies includes a pair of flipper control handles located on opposite length-extending walls. Score keeping assemblies attached to opposite length-extending walls. Each of the score keeping assemblies includes support posts attached to respective length-extending walls. A transverse beam is connected between the support posts, and a plurality of beads are retained on the transverse beam.

The bumpers includes resilient bumper strips and bumper posts. The resilient bumper strips are located on the ground portion in the vicinity of the walls, and wherein one of the bumper posts is located at the center of the ground portion.

Each of the first pair of flippers and the second pair of flippers includes a bat portion located on the top side of the ground portion. A flipper hinge pin is connected to the bat portion and extends through the ground portion to the bottom side. A flipper drive plate is connected to the flipper hinge pin and is located on the bottom side of the ground portion. Each of the first pair of flipper control assemblies and the second pair of flipper control assemblies includes a push bar supported by the bottom side of the ground portion and a respective length-extending wall. The push bar includes a first end in contact with a flipper drive plate and includes a second end in contact with a flipper control handle. A flipper return spring is connected between the flipper drive plate and the bottom side of the ground portion. A flipper-control-handle return spring is located between the respective flipper control handle and the respective length-extending wall.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved slap ball table game apparatus which has all of the advantages of the prior art and none of the disadvantages.

It is another object of the present invention to provide a new and improved slap ball table game apparatus which may be easily and efficiently manufactured and marketed.

It is a further object of the present invention to provide a new and improved slap ball table game apparatus which is of durable and reliable construction.

An even further object of the present invention is to provide a new and improved slap ball table game apparatus which is susceptible of a low cost of manufacture with regard to both materials and labor, and which accordingly is then susceptible of low prices of sale to the consuming public, thereby making such slap ball table game apparatus available to the buying public.

Still yet a further object of the present invention is to provide a new and improved slap ball table game apparatus which permits two players to play simultaneously.

Still another object of the present invention is to provide a new and improved slap ball table game apparatus that permits rapid alternation from offensive to defensive to offensive, and so on, play between two players playing simultaneously.

Yet another object of the present invention is to provide a new and improved slap ball table game apparatus which does not employ electric power.

Even another object of the present invention is to provide a new and improved slap ball table game apparatus that is lightweight and portable and can easily be placed on a horizontal table to use the device.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged cross-sectional view of the portion of the embodiment of the slap ball table game apparatus of FIG. 1 taken along line 3—3 thereof.

FIG. 4 is an enlarged cross-sectional view of the portion of the embodiment of the slap ball table game apparatus of FIG. 1 taken along line 4—4 thereof.

DESCRIPTION OF THE PREFERRED EMBODIMENT

With reference to the drawings, a new and improved slap ball table game apparatus embodying the principles and concepts of the present invention will be described.

Figure 1:
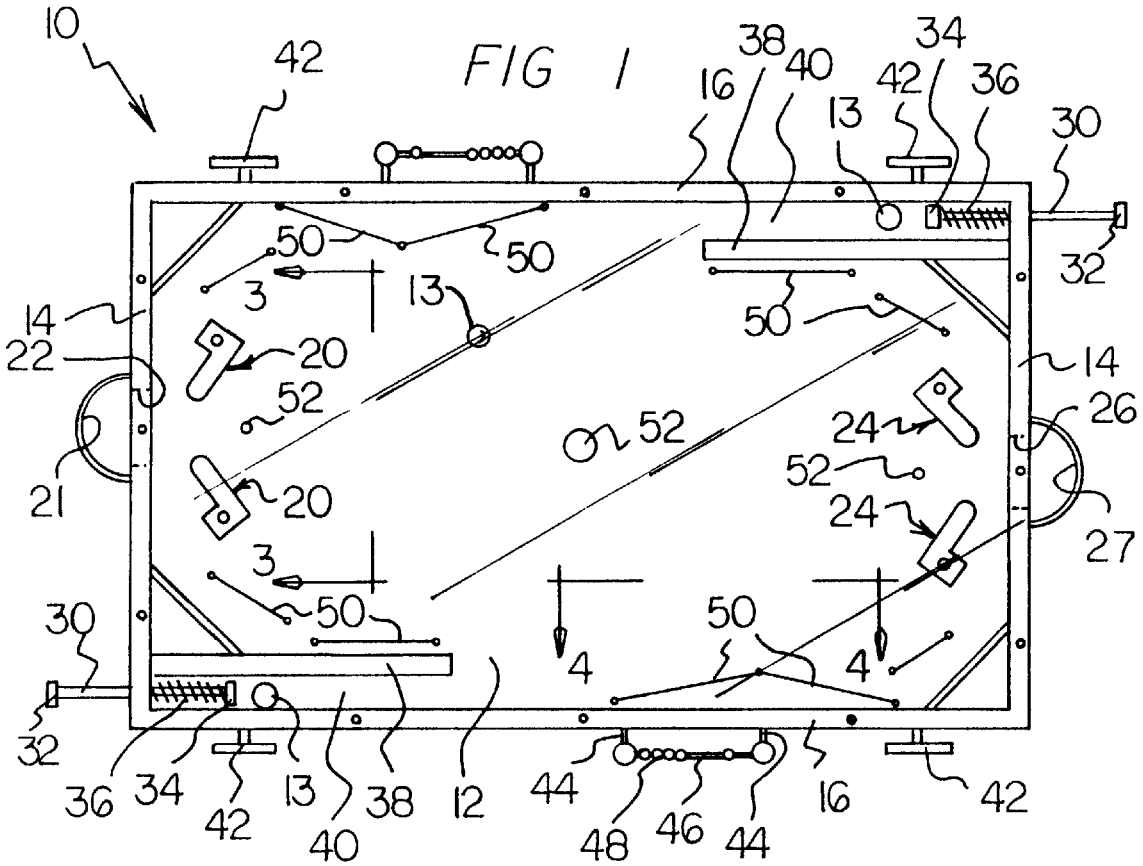
FIG. 1 is a top view showing a preferred embodiment of the slap ball table game apparatus of the invention.
Figure 2:
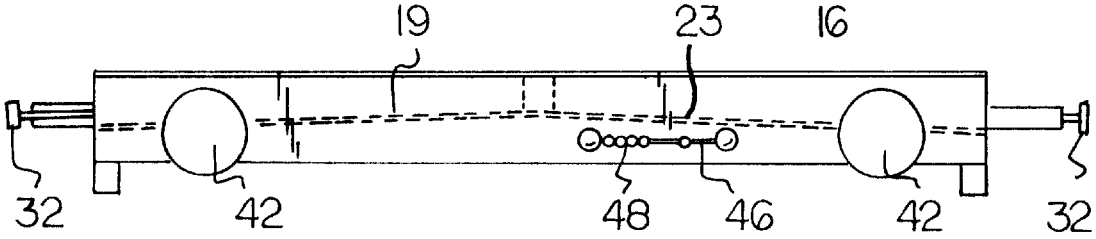
FIG. 2 is a side view of a long side of the embodiment of the slap ball table game apparatus shown in FIG. 1.
Figure 5:
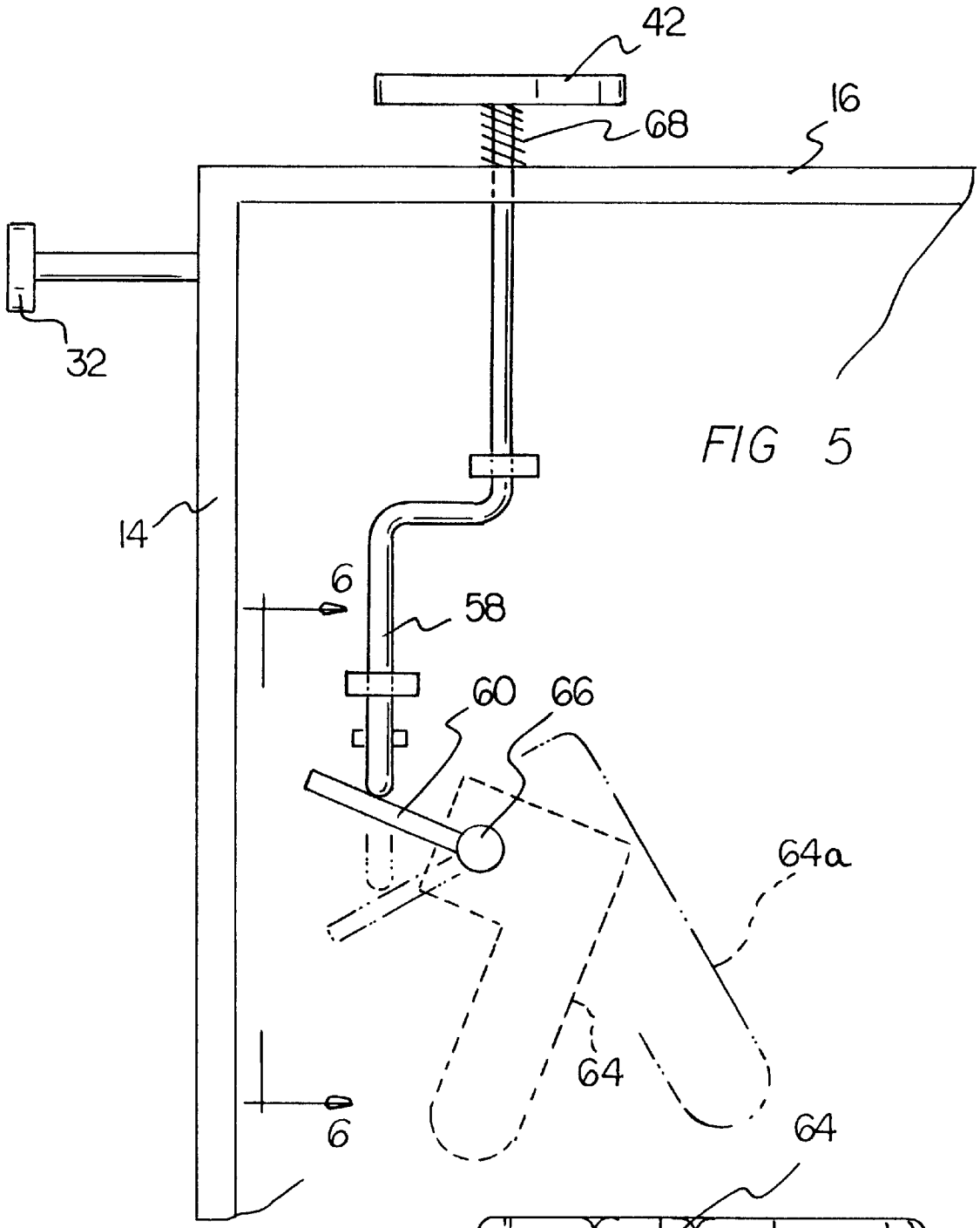
FIG. 5 is an enlarged bottom view of a corner portion of the embodiment of the invention shown in FIG. 1.
Figure 6:
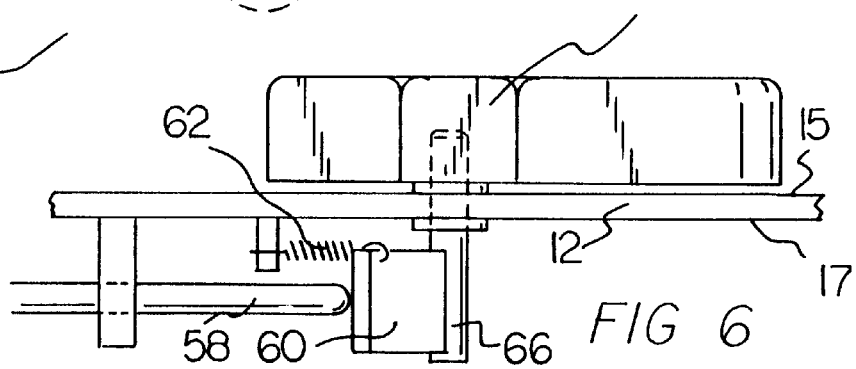
FIG. 6 is a cross-sectional view of a portion of the embodiment of the invention shown in FIG. 5 taken along line 6—6 thereof.

Turning to FIGS. 1–6, there is shown an exemplary embodiment of the slap ball table game apparatus of the invention generally designated by reference numeral 10. In its preferred form, slap ball table game apparatus 10 includes a playing field assembly which includes a ground portion 12 and walls which project of upward from edges of the ground portion 12. The ground portion 12 includes a top side 15 and a bottom side 17. The walls include width-extending walls 14 and length-extending walls 16. The width-extending walls 14 and the length-extending walls 16 are arranged on the top side 15 of the ground portion 12 in a four-cornered rectangular array. A first ball launching assembly is located at a first corner of the four-cornered rectangular array. A second ball launching assembly located at a second corner of the four-cornered rectangular array. A first pair of flippers 20 are located on the ground portion 12. A first pair of flipper control assemblies are provided for controlling the first pair of flippers 20. The first pair of flipper control assemblies are supported by the ground portion 12. A first goal area 22 is located on the ground portion 12 behind and between the first pair of flippers 20. A first ball retention region 21 is located behind the first goal area 22.

A second pair of flippers 24 are located on the ground portion 12. A second pair of flipper control assemblies are provided for controlling the second pair of flippers 24. The second pair of flipper control assemblies are supported by the ground portion 12. A second goal area 26 is located on the ground portion 12 behind and between the second pair of flippers 24. A second ball retention region 27 is located behind the second goal area 26.

An array of bumpers are located on the ground portion 12, and a plurality of balls 13 are launched by the first ball launching assembly and the second ball launching assembly. Each of the first ball launching assembly and the second ball launching assembly is located at a respective corner in the four-cornered rectangular array and includes a launch rod 30 supported by a width-extending wall 14. The launch rod 30 has a handle portion 32 and a ball driver portion 34. A drive spring 36 is located between the ball driver portion 34 and the width-extending wall 14. A guide wall 38 is supported by the ground portion 12. The guide wall 38 is parallel to the length-extending walls 16. The combination of one of the length-extending walls 16, the guide wall 38, and the ground portion 12 define a ball-launching runway 40.

The ground portion 12 can include a first downwardly sloping portion 19 and a second downwardly sloping portion 23. The first downwardly sloping portion 19 and the second downwardly sloping portion 23 slope downward from a center portion of the ground portion 12 to peripheral portions of the ground portion 12. Each of the first goal area 22 and the second goal area 26 is located medially along a respective width-extending wall 14. Each of the first goal area 22 and the second goal area 26 is an aperture in a respective width-extending wall 14.

Each of the first pair of flipper control assemblies and the second pair of flipper control assemblies includes a pair of flipper control handles 42 located on opposite length-extending walls 16. Score keeping assemblies attached to opposite length-extending walls 16. Each of the score keeping assemblies includes support posts 44 attached to respective length-extending walls 16. A transverse beam 46 is connected between the support posts 44, and a plurality of beads 48 are retained on the transverse beam 46.

The bumpers includes resilient bumper strips 50 and bumper posts 52. The resilient bumper strips 50 are located on the ground portion 12 in the vicinity of the walls, and wherein one of the bumper posts 52 is located at the center of the ground portion 12.

Each of the first pair of flippers 20 and the second pair of flippers 24 includes a bat portion 64 located on the top side 15 of the ground portion 12. A flipper hinge pin 66 is connected to the bat portion 64 and extends through the ground portion 12 to the bottom side 17. A flipper drive plate 60 is connected to the flipper hinge pin 66 and is located on the bottom side 17 of the ground portion 12. Each of the first pair of flipper control assemblies and the second pair of flipper control assemblies includes a push bar 58 supported by the bottom side 17 of the ground portion 12 and a respective length-extending wall 16. The push bar 58 includes a first end in contact with a flipper drive plate 60 and includes a second end in contact with a flipper control handle 42. A flipper return spring 62 is connected between the flipper drive plate 60 and the bottom side 17 of the ground portion 12. A flipper-control-handle return spring 68 is located between the respective flipper control handle 42 and the respective length-extending wall 16.

To use the table game apparatus 10 of the invention, two players play the game. A first player will launch a ball 13 by pulling the handle portion 32 of the first ball launching assembly and releasing. The drive spring 36 pushes the ball 13 along the ball-launching runway 40 to bounce off of a resilient bumper strip 50 and further bounce around the ground portion 12. The second player uses his second pair of flippers 24 to guard his second goal area 26 and prevent the ball 13 from entering the second goal area 26. Moreover, the second player uses his second pair of flippers 24 to attempt to propel the ball 13 into the first goal area 22 of the first player. Of course, the first player uses his first pair of flippers 20 to protect his first goal area 22 and to try to propel the ball into the second goal area 26. When the first player lands a ball 13 in the second player's second goal area 26, the first player shifts a bead 48 on his respective score keeping assembly to register the goal.

Similarly, when the second player lands a ball 13 in the first player's first goal area 22, the second player moves a bead 48 in his respective score keeping assembly. After the first launched ball 13 lands in one of the player's goal areas, the opposing player can launch a ball 13 from the second ball launching assembly. Play can alternate back and forth in this manner until the game is over, as reflected in a predetermined number of goals to be attained by a respective player. If desired, more than one ball 13 can be in play at any given time.

When each player operates a respective flipper, the player smacks a flipper control handle 42 in a direction perpendicular to the respective length-extending wall 16. When this is done, the force of the smack on the flipper control handle 42 overcomes the flipper-control-handle return spring 68 and is transmitted through the push bar 58 to the flipper drive plate 60. The flipper drive plate 60 moves around the flipper hinge pin 66, and in doing so, stretches the flipper return spring 62. When this is done, the bat portion 64 of the flipper moves from position 64 in FIG. 5 to position 64*a* in FIG. 5, whereby the bat portion 64 can bat the ball 13 away from the respective player's goal towards the opposite player's goal.

Once the respective player removes his hand from the flipper control handle 42, the flipper-control-handle return spring 68 will return the flipper control handle 42 to its original position, and the flipper return spring 62 will return the flipper drive plate 60 and the bat portion 64 to their original position to away the next smack on the flipper control handle 42.

The components of the slap ball table game apparatus of the invention can be made from inexpensive and durable metal, plastic, and rubber materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved slap ball table game apparatus that is low in cost, relatively simple in design and operation, and which may advantageously be used to permit two players to play simultaneously. With the invention, a slap ball table game apparatus is provided which permits rapid alternation from offensive to defensive to offensive, and so on, play between two players playing simultaneously. With the invention, a slap ball table game apparatus is provided which does not employ electric power. With the invention, a slap ball table game apparatus is provided which is lightweight and portable and can easily be placed on a horizontal table to use the device.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A table game apparatus, comprising:

a playing field assembly which includes a ground portion and walls which project upward from edges of the ground portion, wherein said ground portion includes a top side and a bottom side, wherein said walls include width-extending walls and length-extending walls, wherein said width-extending walls and said length-extending walls are arranged on said top side of said ground portion in a four-cornered rectangular array, a first ball launching assembly located at a first corner of said four-cornered rectangular array, a second ball launching assembly located at a second corner of said four-cornered rectangular array, a first pair of flippers located on said ground portion, a first pair of flipper control assemblies for controlling said first pair of flippers, wherein said first pair of flipper control assemblies are supported by said ground portion, a first goal area located on said ground portion behind and between said first pair of flippers, and a first ball retention region located behind said first goal area, a second pair of flippers located on said ground portion, a second pair of flipper control assemblies for controlling said second pair of flippers, wherein said second pair of flipper control assemblies are supported by the ground portion, a second goal area located on said ground portion behind and between said second pair of flippers, a second ball retention region located behind said second goal area, an array of bumpers located on said ground portion, and a plurality of balls launched by said first ball launching assembly and said second ball launching assembly, and wherein said apparatus further includes score keeping assemblies attached to opposite length-extending walls.

2. The apparatus of claim 1 wherein each of said first ball launching assembly and said second ball launching assembly is located at a respective corner in said four-cornered rectangular array and includes a launch rod supported by a width-extending wall.

3. The apparatus of claim 2 wherein:

said launch rod has a handle portion and a ball driver portion, a drive spring is located between said ball driver portion and said width-extending wall, and a guide wall is supported by said ground portion.

4. The apparatus of claim 3 wherein said guide wall is parallel to said length-extending walls.

5. The apparatus of claim 1 wherein said ground portion includes a first downwardly sloping portion and a second downwardly sloping portion, and wherein said first downwardly sloping portion and said second downwardly sloping portion slope downward from a center portion of said ground portion to peripheral portions of said ground portion.

6. The apparatus of claim 1 wherein each of said first goal area and said second goal area is located medially along a respective width-extending wall.

7. The apparatus of claim 1 wherein each of said first goal area and said second goal area is an aperture in a respective width-extending wall.

8. The apparatus of claim 1 wherein each of said first pair of flipper control assemblies and said second pair of flipper control assemblies includes a pair of flipper control handles located on opposite length-extending walls.

9. The apparatus of claim 1 wherein each of said score keeping assemblies includes support posts attached to respective length-extending walls.

10. The apparatus of claim 9, further including:

a transverse beam connected between said support posts, and a plurality of beads retained on said transverse beam.

11. The apparatus of claim 1 wherein said bumpers includes resilient bumper strips and bumper posts.

12. The apparatus of claim 11 wherein said resilient bumper strips are located on said ground portion in the vicinity of said walls, and wherein one of said bumper posts is located at the center of said ground portion.

13. The apparatus of claim 1 wherein each of said first pair of flippers and said second pair of flippers includes a bat portion located on said top side of said ground portion.

14. The apparatus of claim 13 wherein a flipper hinge pin is connected to said bat portion and extends through said ground portion to said bottom side.

15. The apparatus of claim 14 wherein a flipper drive plate is connected to said flipper hinge pin and is located on said bottom side of said ground portion.

16. A table game apparatus, comprising:

a playing field assembly which includes a ground portion and walls which project upward from edges of the ground portion, wherein said around portion includes a top side and a bottom side, wherein said walls include width-extending walls and length-extending walls, wherein said width-extending walls and said length-extending walls are arranged on said top side of said ground portion in a four-cornered rectangular array, a first ball launching assembly located at a first corner of said four-cornered rectangular array, a second ball launching assembly located at a second corner of said four-cornered rectangular array, a first pair of flippers located on said ground portion, a first pair of flipper control assemblies for controlling said first pair of flippers, wherein said first pair of flipper control assemblies are supported by said around portion, a first coal area located on said around portion behind and between said first pair of flippers, and a first ball retention region located behind said first coal area, a second pair of flippers located on said around portion, a second pair of flipper control assemblies for controlling said second pair of flippers, wherein said second pair of flipper control assemblies are supported by the ground portion, a second goal area located on said around portion behind and between said second pair of flippers, a second ball retention region located behind said second goal area, an array of bumpers located on said around portion, and a plurality of balls launched by said first ball launching assembly and said second ball launching assembly, and wherein each of said first pair of flipper control assemblies and said second pair of flipper control assemblies includes a push bar supported by said bottom side of said ground portion and a respective length-extending wall.

17. The apparatus of claim 16 wherein:

said push bar includes a first end in contact with a flipper drive plate and includes a second end in contact with a flipper control handle, a flipper return spring is connected between said flipper drive plate and said bottom side of said ground portion, a flipper-control-handle return spring is located between said respective flipper control handle and said respective length-extending wall.

* * * * *